US011330684B2

(12) United States Patent
Vavrik et al.

(10) Patent No.: US 11,330,684 B2
(45) Date of Patent: May 10, 2022

(54) SYSTEM AND METHOD FOR MATCHING LIGHT OUTPUT FROM LED LUMINAIRES

(71) Applicant: Robe Lighting s.r.o., Roznov pod Radhostem (CZ)

(72) Inventors: Jindrich Vavrik, Zubri (CZ); Josef Valchar, Prostredni Becva (CZ)

(73) Assignee: Robe Lighting s.r.o., Roznov pod Radhostem (CZ)

( * ) Notice: Subject to any disclaimer, the term of this patent is extended or adjusted under 35 U.S.C. 154(b) by 0 days.

(21) Appl. No.: 17/011,546

(22) Filed: Sep. 3, 2020

(65) Prior Publication Data

US 2020/0404757 A1 Dec. 24, 2020

Related U.S. Application Data

(60) Provisional application No. 62/895,357, filed on Sep. 3, 2019.

(51) Int. Cl.
*H05B 45/22* (2020.01)
*H05B 45/12* (2020.01)
(Continued)

(52) U.S. Cl.
CPC ..... *H05B 45/12* (2020.01); *F21V 23/003* (2013.01); *H05B 45/22* (2020.01); *H05B 47/165* (2020.01); *F21Y 2115/10* (2016.08)

(58) Field of Classification Search
CPC ..... H05B 45/12; H05B 47/165; H05B 45/22; F21V 23/003; F21Y 2115/10
See application file for complete search history.

(56) References Cited

U.S. PATENT DOCUMENTS

2006/0006821 A1* 1/2006 Singer ..... H05B 45/00 315/312
2010/0052542 A1* 3/2010 Siemiet ..... F21K 9/278 315/129
(Continued)

FOREIGN PATENT DOCUMENTS

WO 2016023754 A1 2/2016
WO WO-2016023754 A1 * 2/2016 ..... H05B 47/105

OTHER PUBLICATIONS

European Extended Search Report; Application No. 20194165.5; dated Jan. 27, 2021; 5 pages.

*Primary Examiner* — Alexander H Taningco
*Assistant Examiner* — Amy X Yang
(74) *Attorney, Agent, or Firm* — Conley Rose, P.C.; Brooks W Taylor

(57) ABSTRACT

A luminaire has a light-emitting diode (LED) light source, a light sensor, and a control system. The control system receives a Measure command measure the current intensity of the LED light source. The control system measures the intensity using the light sensor, stores current intensity data in non-volatile memory, obtains the LED light source's previous intensity, selects an indicator color representing how much the current intensity is reduced from the previous intensity, and causes the luminaire to emit a light beam having the indicator color. The control system also receives an Adjust command to reduce the LED light source to a total intensity reduction amount. The control system obtains the LED light source's current reduction amount, determines whether the total intensity reduction amount is more than the current reduction amount, and, if so, causes the LED light source to emit a reduced intensity light beam.

17 Claims, 7 Drawing Sheets

(51) Int. Cl.

| | |
|---|---|
| ***F21V 23/00*** | (2015.01) |
| ***H05B 47/165*** | (2020.01) |
| *F21Y 115/10* | (2016.01) |

(56) References Cited

U.S. PATENT DOCUMENTS

| | | | | |
|---|---|---|---|---|
| 2011/0291564 | A1* | 12/2011 | Huang | F21V 23/0457 315/77 |
| 2013/0293112 | A1* | 11/2013 | Reed | H05B 45/20 315/131 |
| 2017/0280532 | A1* | 9/2017 | Akiyama | H05B 45/46 |

* cited by examiner

SYSTEM AND METHOD FOR MATCHING LIGHT OUTPUT FROM LED LUMINAIRES

CROSS-REFERENCE TO RELATED APPLICATIONS

This application claims priority to U.S. Provisional Application No. 62/895,357 filed on Sep. 3, 2019 by Jindřich Vavřik, et al. entitled, "System and Method for Matching Light Output from LED Luminaires", which is incorporated by reference herein as if reproduced in its entirety.

TECHNICAL FIELD OF THE DISCLOSURE

The disclosure generally relates to automated luminaires, and more specifically to a method for matching light output from light-emitting diode (LED) luminaires.

BACKGROUND

Luminaires with automated and remotely controllable functionality (referred to as automated luminaires) are well known in the entertainment and architectural lighting markets. Such products are commonly used in theatres, television studios, concerts, theme parks, night clubs, and other venues. A typical automated luminaire provides control from a remote location of the pan and tilt functions of the luminaire allowing the operator to control the direction the luminaire is pointing and thus the position of the light beam on the stage or in the studio. Typically, this position control is done via control of the luminaire's position in two orthogonal rotational axes usually referred to as pan and tilt. Many automated luminaires additionally or alternatively provide control from the remote location of other parameters such as intensity, focus, beam size, beam shape, and/or beam pattern of light beam(s) emitted from the luminaire. In particular, control is often provided for the color of the output beam which may be provided by controlling the insertion of dichroic colored filters across the light beam.

SUMMARY

In a first embodiment, a luminaire includes a light-emitting diode (LED) light source, a light sensor, and a control system. The LED light source emits a light beam. The light sensor is optically coupled to the LED light source, measures an intensity of the light beam, and produces an intensity signal based on the measured intensity. The control system is electrically coupled to the LED light source, a non-volatile memory, and to the light sensor. The control system receives via a data link a Measure command that instructs the luminaire to measure the current intensity of the LED light source's light beam. In response to the Measure command, the control system obtains the intensity signal from the light sensor, stores current intensity data that represents the intensity signal in the non-volatile memory, obtain previous intensity data that represents a previously measured intensity of the LED light source's light beam, selects an indicator color to represent an amount by which the current intensity data is less than the previous intensity data, and causes the luminaire to emit a beam of light having the indicator color. The control system also receives via the data link an Adjust command having total reduction data that represents a total intensity reduction amount for a reduced intensity light beam from the LED light source. In response to the Adjust command, the control system obtains a current reduction amount that represents the amount by which the current intensity data is less than the previous intensity data, determines whether the total intensity reduction amount is greater than the current reduction amount, and causes the LED light source to emit a reduced intensity light beam when the total reduction amount is greater than the current reduction amount.

In a second embodiment, a luminaire includes an LED light source, a light sensor, and a control system. The LED light source emits a light beam. The light sensor is optically coupled to the LED light source, measures a current intensity of the light beam, and produces an intensity signal based on the measured intensity. The control system is electrically coupled to the LED light source, a non-volatile memory, and the light sensor. The control system obtains the intensity signal from the light sensor, stores current intensity data representing the intensity signal in the non-volatile memory, obtains previous intensity data that represents a previously measured intensity of the light beam emitted by the LED light source, selects an indicator color to represent an amount by which the current intensity data is less than the previous intensity data, and causes the luminaire to emit a beam of light having the indicator color.

In a third embodiment, a luminaire includes an LED light source and a control system. The LED light source emits a light beam. The control system is electrically coupled to the LED light source and receives via a data link an Adjust command having total reduction data that represents a total intensity reduction amount for a reduced intensity light beam from the LED light source. In response to the command, the control system obtains a current reduction amount that represents an amount by which a current intensity of the LED light source's full intensity light beam is less than a previously measured intensity of the LED light source's full intensity light beam, determines whether the total intensity reduction amount is greater than the current reduction amount, and causes the LED light source to emit a reduced intensity light beam when the total reduction amount is greater than the current reduction amount.

BRIEF DESCRIPTION OF THE DRAWINGS

For a more complete understanding of this disclosure, reference is now made to the following brief description, taken in conjunction with the accompanying drawings in which like reference numerals indicate like features.

DETAILED DESCRIPTION

Preferred embodiments are illustrated in the figures, like numerals being used to refer to like and corresponding parts of the various drawings.

Figure 1:
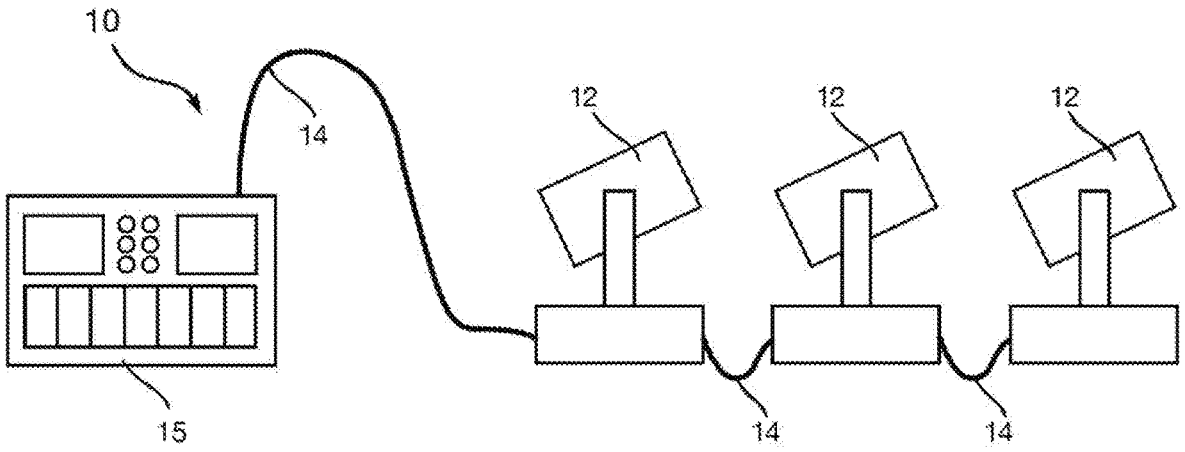
FIG. 1 presents a schematic view of a luminaire system according to the disclosure.

FIG. 1 presents a schematic view of a luminaire system 10 according to the disclosure. The luminaire system 10 includes a plurality of luminaires 12 according to the disclosure. The luminaires 12 each contains on-board a light source, one or more of color changing systems, light modulation devices, and pan and/or tilt systems to control an orientation of a head of the luminaire 12. Mechanical drive systems to control parameters of the luminaire 12 include motors or other suitable actuators coupled to a control system, as described in more detail with reference to FIG. 2, which is configured to control the motors or other actuators.

In addition to being connected to mains power either directly or through a power distribution system, the control system of each luminaire 12 is connected in series or in parallel by a data link 14 to one or more control desks 15. Upon actuation by an operator, the control desk 15 sends control signals via the data link 14, where the control signals are received by the control system of one or more of the luminaires 12. The control systems of the one or more of the luminaires 12 that receive the control signals may respond by changing one or more of the parameters of the receiving luminaires 12. The control signals are sent by the control desk 15 to the luminaires 12 using DMX-512, Art-Net, ACN (Architecture for Control Networks), Streaming ACN, or other suitable communication protocol.

The luminaires 12 may include stepper motors to provide the movement for internal optical systems. Examples of such optical systems include gobo wheels, effects wheels, and color mixing (or other color changing) systems, as well as prism, iris, shutter, and lens movement systems.

Some luminaires 12 include an LED based light source designed to collate and direct light through the optical systems installed in the luminaire 12. The LED light sources along with associated collimating and directing optics are referred to herein as a light engine. Some LED light engines include LEDs of a single color, such as white. Other LED light engines include LEDs of a range of colors, the brightness of each LED or each color of LED controllable individually to provide additive mixing of the LED outputs.

Some LEDs used in such light engines are subject to losing light output (or light intensity) through the life of the LED. As used herein, "light output" means a measurement of light beam intensity such as a measurement proportional to lux, footcandles, or candela. Time, temperature, and operating conditions are some of the factors that may affect the rate of light output loss. The LEDs in heavily used luminaires may lose light output more rapidly than the LEDs in other, more lightly used luminaires in the same system, even though all the luminaires entered use at the same time.

LED luminaires may be calibrated at the time of manufacture such that the light output of each luminaire is substantially the same, for example within an allowed tolerance of 5%. However, when the luminaires undergo different usage patterns, their light outputs are likely to reduce (or degrade) at different rates, and with the passage of time the light output of the luminaires will no longer be substantially the same. Such differences in light output may become visible to a user of the system, but it is difficult for the user to determine what changes to make to the commanded intensities of the individual fixtures to compensate for the differences in light output. In some luminaire systems, such changes are determined through trial and error, or the light output of each fixture is individually measured and recorded. The luminaire system 10 according to the disclosure, enables the user to more easily determine the amount of reduction of light outputs from each of the luminaires in the system and, additionally, to adjust the light outputs from some or all of the luminaires so that they more closely match.

Figure 2:
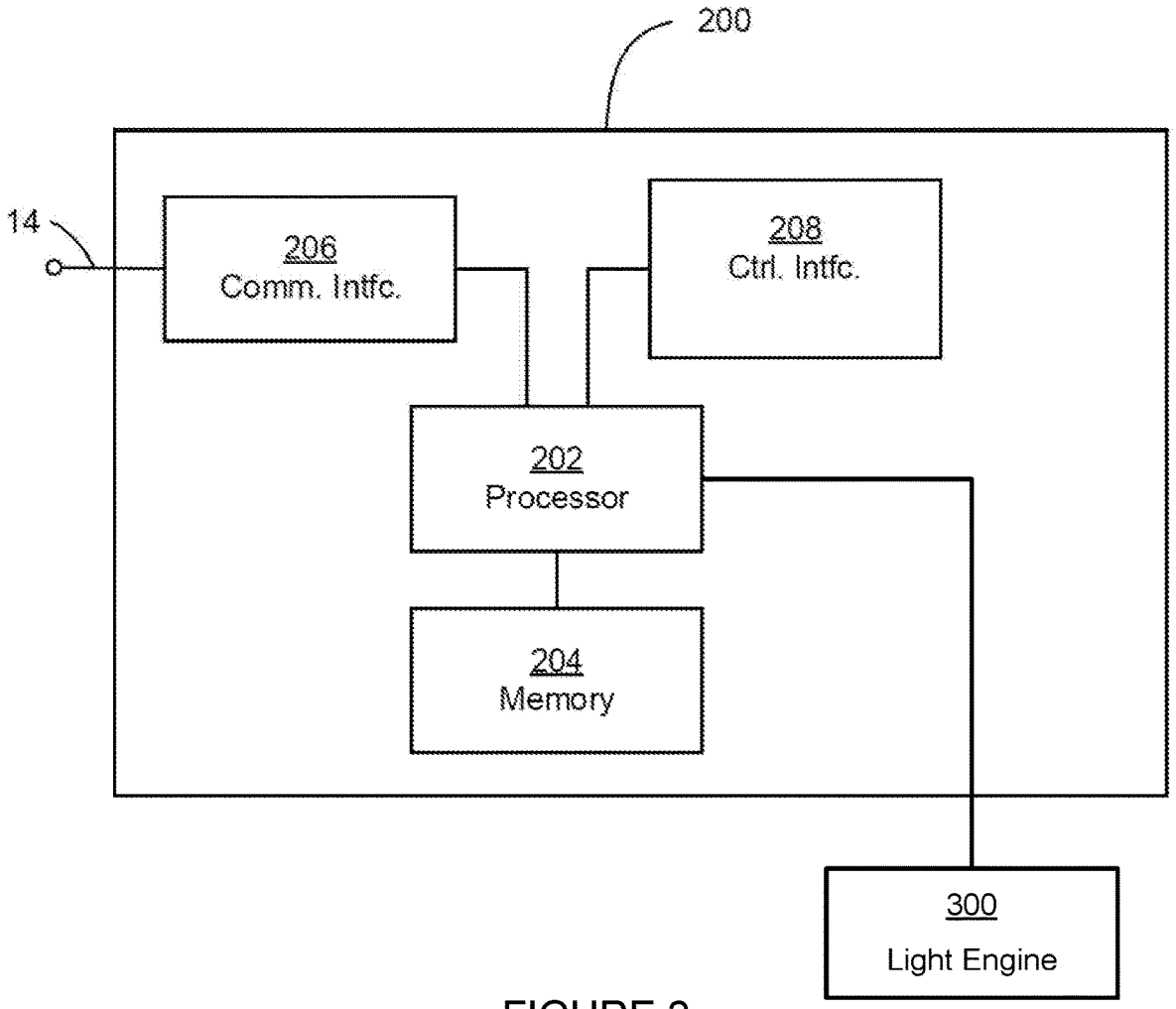
FIG. 2 presents a block diagram of a control system for a luminaire according to the disclosure.

FIG. 2 presents a block diagram of a control system (or controller) 200 for a luminaire 12 according to the disclosure. The control system 200 is suitable for use with the LED light engine and other systems according to the disclosure. The control system 200 is also suitable for controlling other control functions of the luminaire system 10. The control system 200 includes a processor 202 electrically coupled to a memory 204. The processor 202 is implemented by hardware and software. The processor 202 may be implemented as one or more Central Processing Unit (CPU) chips, cores (e.g., as a multi-core processor), field-programmable gate arrays (FPGAs), application specific integrated circuits (ASICs), and digital signal processors (DSPs).

The processor 202 is further electrically coupled to and in communication with a communication interface 206. The communication interface 206 is coupled to, and configured to communicate via, the data link 14. The processor 202 is also coupled via a control interface 208 to one or more sensors, motors, actuators, controls and/or other devices, which may control one or more of gobo wheels, effects wheels, and color mixing (or other color changing) systems, as well as prism, iris, shutter, and lens movement systems. In the luminaire 12, a light level sensor that produces an analog or digital signal representing a light intensity measured by the light sensor is electrically coupled to the processor 202 by the control interface 208. The processor 202 is further electrically coupled to and in communication with an LED light engine 300. The processor 202 is configured to receive control signals from the data link 14 via the communication interface 206 and, in response, to control the LED light engine and other mechanisms of the luminaire 12.

The LED light engine 300 may also contain a control system that is similar to the control system 200 and is configured to receive signals from and send signals to the processor 202. In other embodiments, the LED light engine 300 may include electronic circuitry that is communicatively coupled to the processor 202 by one or more serial links and/or data buses.

The control system 200 is suitable for implementing processes, module control, LED brightness control, and other functionality as disclosed herein, which may be implemented as instructions stored in the memory 204 and executed by the processor 202. The memory 204 comprises one or more disks and/or solid-state drives and may be used to store instructions and data that are read and written during program execution. The memory 204 may be volatile and/or non-volatile and may be read-only memory (ROM), random access memory (RAM), ternary content-addressable memory (TCAM), and/or static random-access memory (SRAM). Similarly the LED light engine 300 may contain a processor and memory, which includes at least writable non-volatile memory, such as flash memory, which retains its contents when power is removed.

Figure 3:
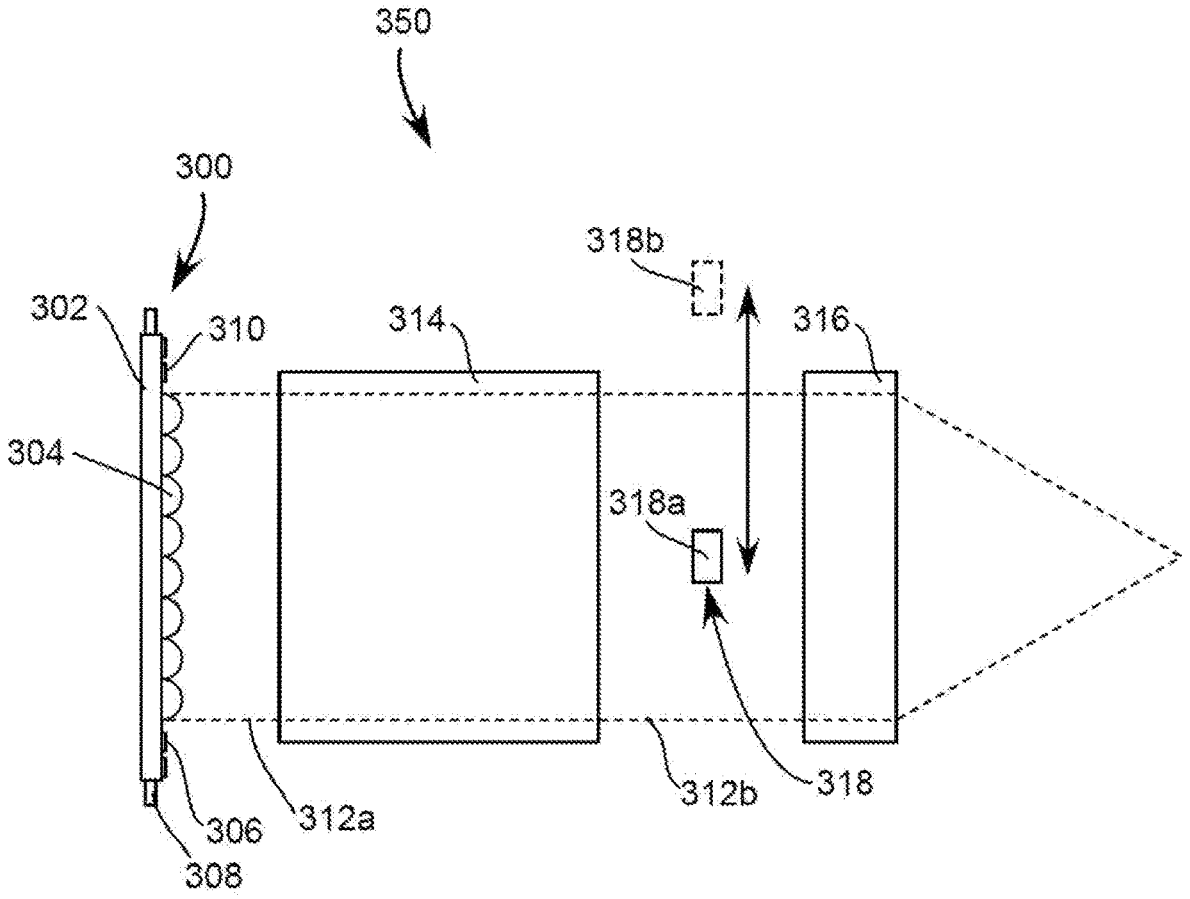
FIG. 3 presents a schematic diagram of an optical system of a luminaire that includes an LED light engine according to the disclosure.

FIG. 3 presents a schematic diagram of an optical system 350 of a luminaire 12 according to the disclosure. The optical system 350 includes an LED light engine 300 (or other LED light source) according to the disclosure. The LED light engine 300 includes a plurality of LED emitters 304 mounted on a substrate 302. The LED light engine 300 also includes electrical connectors 308, configured to power the LED emitters 304 and to transmit and receive data. In some embodiments, electronic circuitry 306 is mounted on substrate 302. In some such embodiments, the electronic circuitry 306 includes a processor, non-volatile memory, and logic components. In such embodiments, the control system 200, described with reference to FIG. 2, is suitable for use as the electronic circuitry 306. In some embodiments, the LED light engine 300 includes a Near-Field Communication (NFC) module 310 that is electrically coupled to the electronic circuitry 306. NFC is a standard protocol for short-range, low-power wireless communication and may be supported in devices such as cellular phones.

The LED light engine 300 further includes optical devices 314, configured to receive the light beam 312*a* emitted by LED emitters 304 and to emit a modified light beam 312*b*. In some embodiments, the optical devices 314 include a collimation and homogenization system, as well as optical systems such as gobos, irises, color wheel(s), framing shutters, a variable focus lens system, and other optical devices suitable for use in theatrical luminaires. In embodiments where the optical system is a projection optical system, the modified light beam 312*b* passes through a projection lens system 316 before exiting the luminaire.

A light sensor 318 is positioned in the modified light beam 312*b* at position 318*a*, where it is optically coupled to the LED light engine 300 and configured to measure a light level proportional to the current light output from LED emitters 304. In other embodiments, the light sensor 318 may be positioned in the light beam 312*a*. In some embodiments, the light sensor 318 is configured to measure only a light level (or light intensity) of the portion of the light beam in which it is positioned.

In other embodiments, the light sensor 318 is configured to measure light level and spectral color information. In some such embodiments, the light sensor 318 comprises a spectrophotometer. In other such embodiments, the light sensor 318 comprises a plurality of light sensors, each covered by a color filter passing light of a selected color band. Such color bands may be selected according to the colors of LEDs comprising the LED light engine 300. In such embodiments, the light sensor 318 measures not only the physical portion of the light beam in which it is positioned, but also the spectral portion of the beam for which it is filtered.

In some embodiments, the light sensor 318 is mounted on a mechanism such as an arm or a wheel that is configured to move the light sensor 318 to position 318*b*, where it is out of the modified light beam 312*b*. In other embodiments, the light sensor 318 is mounted to one of the optical devices 314, such as a prism, and configured so that when the prism is inserted into the modified light beam 312*b*, so is the light sensor 318.

In some embodiments, the light sensor 318 is electrically and communicatively connected to the control system 200 of the luminaire 12. In other embodiments, the light sensor 318 is electrically and communicatively connected to the electronic circuitry 306 of the LED light engine 300.

Figure 4:
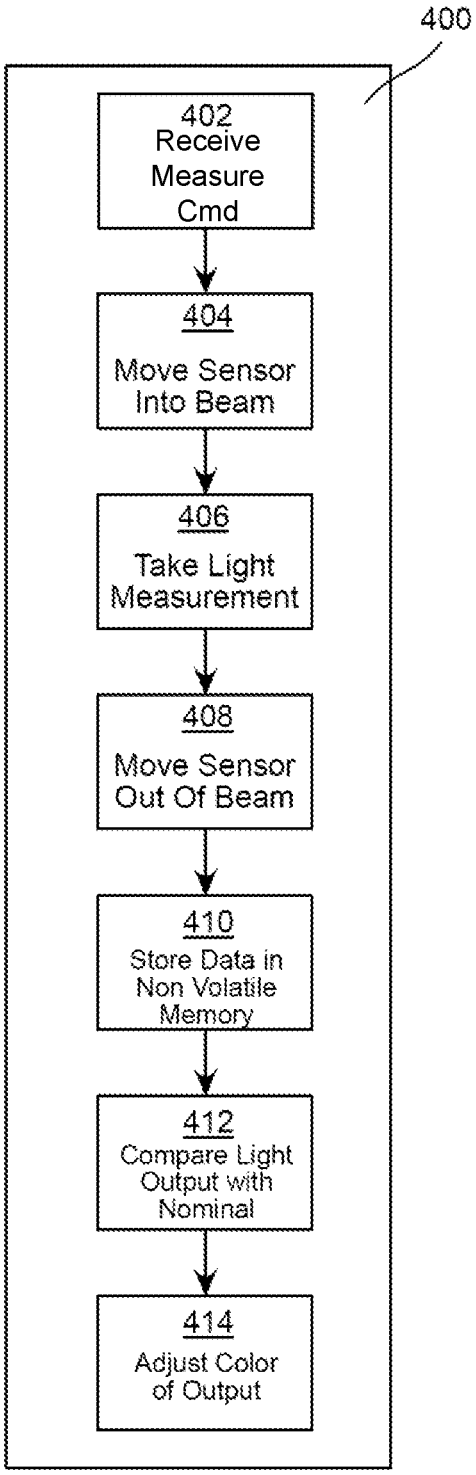
FIG. 4 presents a block diagram of a light measurement procedure according to the disclosure.

FIG. 4 presents a block diagram of a light measurement and indication procedure 400 according to the disclosure. A luminaire 12 according to the disclosure is configured to determine an amount by which its light output has degraded from when it was first manufactured, and to signal the amount of degradation through a temporary color of the light beam emitted from the luminaire. Such a luminaire according to the disclosure may also be configured to adjust its light output to a level lower than the output it is capable of.

The processor 202 of the control system 200 of the luminaire 12 receives a Measure command in step 402 via data link 14, the Measure command instructing the luminaire 12 to perform a light level reading. In response to the Measure command, the processor 202 first obtains an intensity signal produced by the light sensor 318, the signal representing an intensity of a light beam emitted by the LED light engine 300.

In step 404, the processor 202 moves the light sensor 318 into the light beam, as described with reference to FIG. 3. Once the light sensor 318 is in position, in step 406 the processor 202 receives a measurement signal from the light sensor 318 relating to the intensity of the light beam. After receiving the measurement signal from the light sensor 318, the processor 202 moves the light sensor 318 out of the light beam in step 408. As described with reference to FIG. 2, in some embodiments the signal received from the light sensor 318 is a digital signal. In other embodiments, the signal is an analog signal that is digitized in the control interface 208.

In step 410, the processor 202 stores current intensity data representing the current intensity of the light beam (as measured by the light sensor 318) in non-volatile memory of the electronic circuitry 306 of the LED light engine 300 and/or non-volatile memory of the memory 204 of the control system 200. In step 412, the processor 202 compares the current intensity data with previous intensity data representing a previously measured light output (or nominal light output) of the LED light engine 300. Such a previous measurement may have been performed when the LED light engine 300 was first installed into the luminaire 12 in the factory or during a subsequent calibration procedure. The nominal light output is also stored in non-volatile memory of the LED light engine 300. In step 412, the processor 202 also calculates a reduction in measured light output from the stored nominal light output of the LED light engine 300.

In the embodiment disclosed herein, the calculated reduction is expressed as a percentage drop (or reduction) in light output. In other embodiments, the amount of reduction may be expressed in units of light intensity or illuminance, such as lumens, lux, footcandles, or candelas.

In embodiments of the luminaire 12 where the LED light engine 300 comprises LEDs emitting light in a plurality of colors and the light sensor 318 comprises a spectrophotometer or a plurality of filtered light sensors, the measurement obtained in step 406 may include a plurality of measurements, which indicate light output from LEDs having a common color or having colors in a spectral range of colors. In such embodiments, the reduction in measured light output that is calculated in step 412 may be calculated based on all of the plurality of measurements, or may be calculated based only on the color or range of colors that have experienced the largest reduction in light output.

In some embodiments, step 412 includes the processor 202 storing data relating to the calculated percentage drop in measured light output. The data may be stored in non-volatile memory of the electronic circuitry 306 of the LED light engine 300 and/or non-volatile memory of the memory 204 of the control system 200.

In step 414, the processor 202 selects an indicator color to represent the calculated amount of reduction in measured light output—in this embodiment, the calculated percentage drop in measured light output. For example, in some embodiments, the indicator color blue is assigned to luminaires whose light output has dropped by 5% or less, the indicator color green is assigned to luminaires whose drop is between 5% and 10%, the indicator color orange is assigned to luminaires whose drop is between 10% and 20%, and the indicator color red is assigned to luminaires whose drop is between 20% and 30%. It should be understood that these indicator colors and ranges are only examples, and any indicator color could be assigned to any range of percentages. Additionally, in other embodiments, the ranges may have different sizes than those in the disclosed embodiment. For example, in some embodiments the ranges may be 0-2%, 3-4%, 5-6%, etc. or 0-5%, 6-10%, 11-15%, etc.

In step 414, the processor 202 also activates a color mechanism of the optical devices 314 to cause the luminaire 12 to emit a beam of the selected indicator color. In embodiments where the LED light engine 300 includes LEDs of a range of colors, the processor 202 commands the electronic circuitry 306 to differentially power the LED emitters 304 to produce light of the selected indicator color. In some embodiments, in step 414 the processor 202 also activates the pan and/or tilt mechanisms of the luminaire 12 to cause the light beam to be emitted from the luminaire 12 in a preset (or user-selected) direction, such as straight down onto the stage or floor, in order to make identification of the colors simpler for the user.

Figure 5:
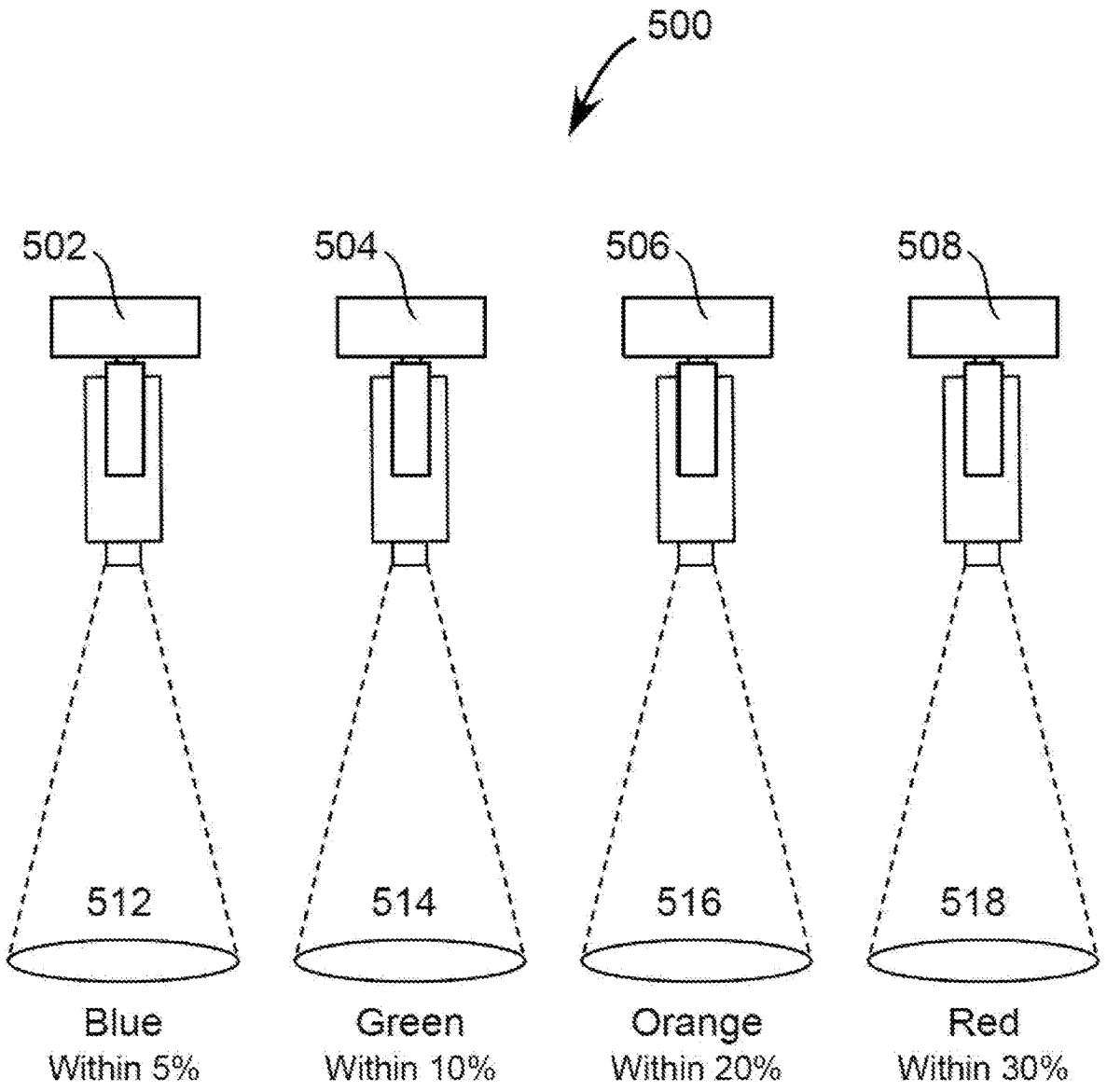
FIG. 5 presents a system of luminaires each indicating light output according to the disclosure.

FIG. 5 presents a system 500 of luminaires according to the disclosure, each indicating the light output of its LED light engine 300 after performing the light measurement and indication procedure 400 described with reference to FIG. 4. Luminaires 502, 504, 506, and 508 are pointing down towards the stage and projecting light beams 512, 514, 516, and 518, respectively. The luminaire 502 is projecting a blue light beam 512, indicating to the user that its light output has a drop that is within 5% of the nominal light output. The luminaire 504 is projecting a green light beam 514 indicating to the user that its light output drop is between 5% and 10% of the nominal light output. The luminaire 506 is projecting an orange light beam 516 indicating to the user that its light output drop is between 10% and 20% of the nominal light output. And, the luminaire 508 is projecting a red light beam 518 indicating to the user that its light output drop is between 20% and 30% of the nominal light output. The user can determine from the color of the light beams 512, 514, 516, and 518 which luminaires are the brightest, and which have lost the most output.

Using this information, the user may move luminaires with a greater drop in light output to positions in the system 500 that the user considers to be less critical to performance of the show. Alternatively, the user may replace luminaires with a greater drop in light output with luminaires having higher light outputs that are not currently being used in the system 500. The user may additionally or alternatively use light adjustment procedure 600 described below.

Figure 6:
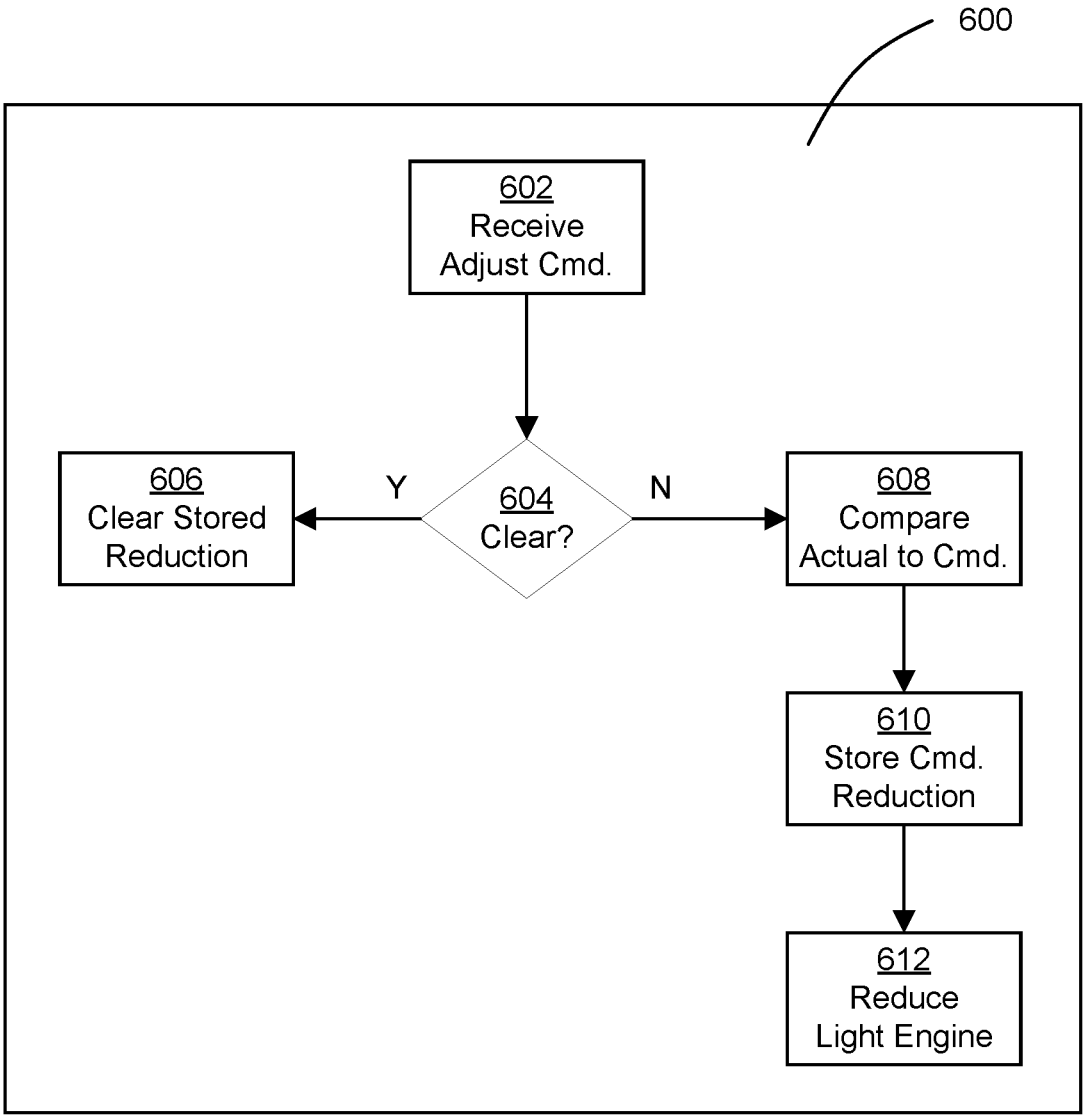
FIG. 6 presents a flowchart of a light adjustment procedure according to the disclosure.

FIG. 6 presents a flowchart of a light adjustment procedure 600 according to the disclosure. A luminaire 12 according to the disclosure is configured to receive an Adjust command from a control desk 15 (as described in more detail below with reference to FIGS. 7A and 7B) and to adjust the light output of its LED light engine 300 according to an adjustment amount that is specified in the received Adjust command. The adjustment amount is data specifying a total reduction in light output from the nominal light output of the LED light engine 300 when it was factory calibrated.

In step 602, the processor 202 of the control system 200 of the luminaire 12 receives an Adjust command signal via data link 14. The Adjust command includes a control parameter value. In step 604, the processor 202 determines whether the received control parameter is Clear flag data or is an adjustment parameter specifying a total reduction amount to reduce the light output of the LED light engine 300 from its nominal light output when it was factory calibrated. The Clear flag data may be a single bit or may be a multi-bit data value. If the received control parameter is a Clear flag, then in step 606, the processor sends a command to the LED light engine 300 to operate at full (or unreduced) light output and causes the clearing of any additional reduction amount stored in the LED light engine 300 and/or in the control system 200.

In step 608, the processor 202 calculates a current percentage drop in light output of the LED light engine 300 by comparing the most recent measured light output of the LED light engine 300 with the nominal light output of the LED light engine 300 when it was factory calibrated. In embodiments where data relating to a previously calculated percentage drop is stored in non-volatile memory, the current percentage drop may be obtained by reading it from such non-volatile memory, rather than by recalculation.

Also in step 608, the processor 202 compares the total reduction amount (or total reduction data) specified in the adjustment parameter of the Adjust command with the current percentage drop in light output of the LED light engine 300. In step 610, if the total reduction amount specifies a greater reduction than the current percentage drop in light output of the LED light engine 300, the processor stores the total reduction amount specified in the adjustment parameter in non-volatile memory of the LED light engine 300 and/or the control system 200.

As will be explained in greater detail with reference to FIGS. 7A and 7B, the total reduction amount is a light output selected by a user so that at least some of the luminaires 12 performing the light adjustment procedure 600 will be able to emit light at the specified reduced output level. In step 612, if the total reduction amount specified in the adjustment parameter indicates a greater reduction than the current percentage drop in light output of the LED light engine 300, the processor 202 calculates an additional reduction amount that the LED light engine 300 must reduce its light output over its current percentage drop in light output to reach the total reduction amount specified in the adjustment parameter. If the total reduction amount specifies a lesser reduction than the current percentage drop in light output of the LED light engine 300, no additional reduction amount is required.

Also in step 612, the processor 202 causes the LED light engine 300 to further reduce its light output by the additional reduction amount (if any) by sending a command signal to the LED light engine 300. In some embodiments, the processor 202 further causes the LED light engine 300 to store data representing the additional reduction amount (if any) in non-volatile memory. In such embodiments, either by storing the data in non-volatile memory or by sending a separate command signal, the processor 202 also causes the LED light engine 300 to continue reducing its light output by the additional reduction amount (if any) each time the luminaire 12 is powered up from a powered-off state until the processor 202 receives a Clear flag in an Adjust command and commands the LED light engine 300 to return to full power in step 606.

In step 610 of some embodiments, the processor 202 stores the total reduction amount specified in the adjustment parameter of the Adjust command in non-volatile memory of the electronic circuitry 306 of the LED light engine 300 and/or non-volatile memory of the memory 204 of the control system 200. In such embodiments, when performing the light measurement and indication procedure 400, the processor 202 performs an additional step of retrieving the stored total reduction amount, recalculating an amount of additional reduction (if any) that is needed to reach the total reduction amount based on the newly measured current percentage drop in light output. In such embodiments, the processor 202 also causes the LED light engine 300 to further reduce its light output by this newly calculated additional reduction amount (if any), to store data representing this newly calculated additional reduction amount in non-volatile memory, and to continue reducing its light output by this additional reduction amount (if any) each time the luminaire 12 is powered up from a powered-off state until the luminaire 12 is commanded to return to full power in step 606 by receiving a Clear flag in an Adjust command. In step 606 of such embodiments, the processor 202 additionally clears the total reduction amount stored in non-volatile memory.

Figure 7A:
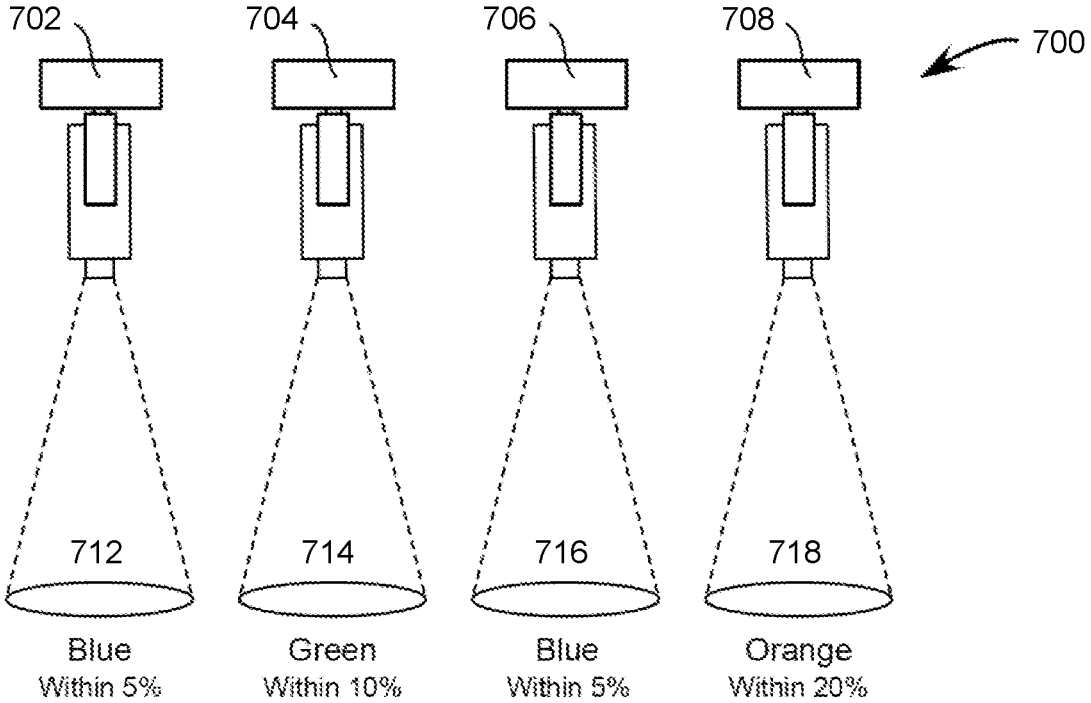
FIGS. 7A and 7B present a system of luminaires according to the disclosure.
Figure 7B:
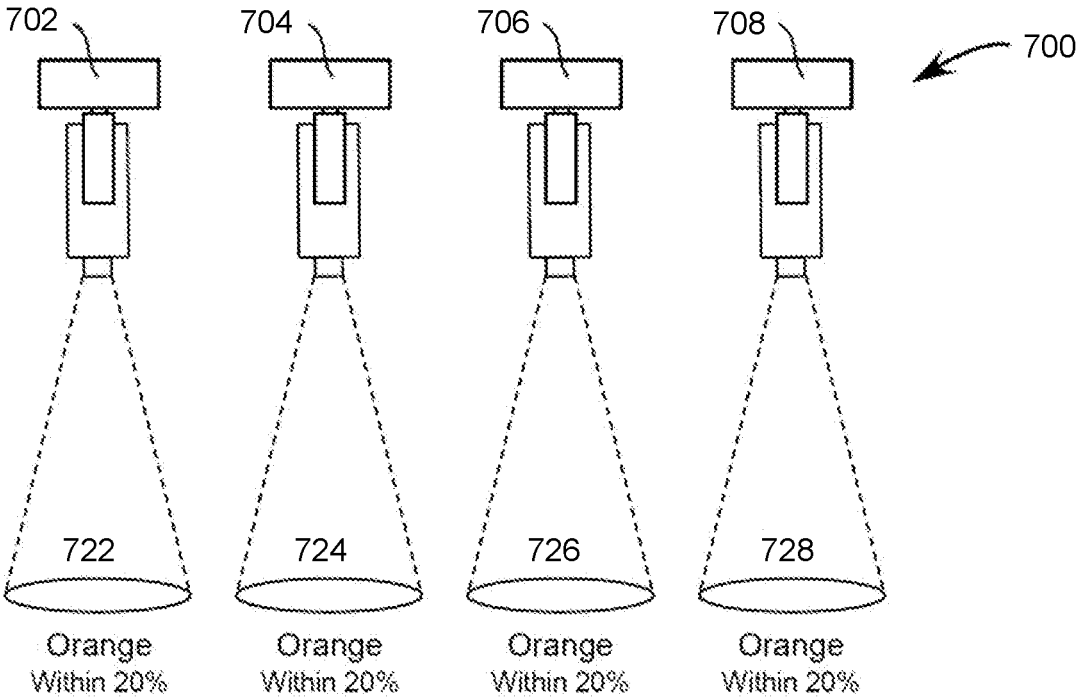

FIGS. 7A and 7B present a system 700 of luminaires 702, 704, 706, and 708 according to the disclosure. In FIG. 7A, the luminaires have performed the light measurement and indication procedure 400 and are indicating their light outputs. In FIG. 7B, the luminaires have performed the light adjustment procedure 600 and are indicating their new, adjusted light output levels.

In FIG. 7A, the luminaires 702, 704, 706, and 708 have received Measure commands and performed the light measurement and indication procedure 400 described with reference to FIG. 4. The luminaires 702, 704, 706, and 708 are now pointing down towards the stage and projecting light beams 712, 714, 716, and 718 respectively. The indicator colors of the beams show that the luminaires 702 and 706 have output drops within 5% of their nominal light output values, the luminaire 704 has an output drop between 5% and 10%, and the luminaire 708 has an output drop between 10% and 20%.

By observing the indicator colors of the beams, a user of the system 700 is able to determine that the luminaire 708 has a 10% to 20% reduction in light output. In response to this determination, rather than repositioning the luminaires in the lighting system according to their light output, as described above, the user may cause some of the luminaires in the system 700 to reduce their light output as needed in order to more closely match the output of the luminaire 708.

To obtain this result, the user sends an Adjust command through data link 14 with an adjustment parameter requesting that all luminaires adjust their outputs to produce a reduced light output, as described above with reference to light adjustment procedure 600. The adjustment parameter specified in the Adjust command may be 10%, 15%, 20%, or any other selected value that the user believes will reduce the visible differences in light outputs between fixtures to an acceptable amount. Each of the luminaire 702, 704, 706, and 708, responds to this command based upon its current measured light output. In the scenario presented in FIG. 7B, the specified adjustment parameter is 20% and each luminaire compares its current light output with a 20% drop from nominal light output and introduces a reduction in its own output that is selected to produce an overall 20% drop in light output from nominal.

In the scenario shown in FIGS. 7A and 7B, in response to the Adjust command, the luminaire 708 has not made any change to its output, as its light output is already reduced between 10% and 20%. The luminaire 704 has responded by reducing its output from its current 10% drop to a 20% drop, and the luminaires 702 and 706 have responded by reducing their outputs from their current 5% drop to a 20% drop. This adjustment procedure results in the configuration shown in FIG. 7B, where all the luminaires 702, 704, 706, and 708 produce outputs with more closely matching light beam intensities 722, 724, 726, and 728.

In some embodiments, after performing the light adjustment procedure 600, the luminaires re-perform the light measurement and indication procedure 400. In such embodiments, the indicator colors shown in FIG. 7B represent the luminaires' reduced light output as measured after application of the adjustment parameter specified in the Adjust command, rather than as calculated during application of the adjustment parameter.

In the scenario described with reference to FIGS. 7A and 7B, after performing the light measurement and indication procedure 400, the user has decided that a 10% to 20% reduction in light output still provides an acceptable level of illumination for the performance being illuminated and has performed light adjustment procedure 600. In another scenario, one or more luminaires may have a light output that is so low that the user chooses not to reduce all the other luminaires to that level. In such scenarios, the user may combine the two strategies described above: (i) performing the light measurement and indication procedure 400, (ii) replacing luminaires in the system having the lowest light output, (iii) repeating the light measurement and indication procedure 400, and (iv) performing light adjustment procedure 600 when the required amount of light output reduction to match luminaires is acceptable.

While only some embodiments of the disclosure have been described herein, those skilled in the art, having benefit of this disclosure, will appreciate that other embodiments may be devised which do not depart from the scope of the disclosure herein. While the disclosure has been described in detail, it should be understood that various changes, substitutions and alterations can be made hereto without departing from the spirit and scope of the disclosure.

What is claimed is:

1. A luminaire, comprising:

a light-emitting diode (LED) light source configured to emit a light beam;

a light sensor, optically coupled to the LED light source and configured to measure a current intensity of a light beam emitted by the LED light source and produce an intensity signal based on the measured intensity; and a control system electrically coupled to the LED light source, to a non-volatile memory, and to the light sensor, the control system configured to:

receive a Measure command via a data link, the Measure command instructing the luminaire to measure the current intensity of the light beam emitted by the LED light source and, in response to receiving the Measure command, to:

obtain the intensity signal from the light sensor;

store in the non-volatile memory current intensity data representing the intensity signal;

obtain previous intensity data that represents a previously measured intensity of the light beam emitted by the LED light source;

calculate a numeric value representing a percentage by which the current intensity data is less than the previous intensity data;

determine a percentage range that includes the numeric value, where the percentage range is one of a plurality of percentage ranges, each percentage range of the plurality of percentage ranges having an associated beam color; and cause the luminaire to emit a beam of light having the beam color associated with the percentage range that includes the numeric value; and receive an Adjust command via the data link, the Adjust command comprising total reduction data representing a total reduction amount for intensity of a reduced intensity light beam emitted by the LED light source and, in response to the Adjust command, to:

obtain a current reduction amount representing an amount by which the current intensity data is less than the previous intensity data;

determine whether the total reduction amount is greater than the current reduction amount; and cause the LED light source to emit a reduced intensity light beam having a reduced intensity when the total reduction amount is greater than the current reduction amount.

2. The luminaire of claim 1, wherein the control system is configured to control a color changing system to cause the luminaire to emit the beam of light having the beam color associated with the percentage range that includes the numeric value.

3. The luminaire of claim 1, wherein:

the LED light source comprises a plurality of LED emitters; and the control system is configured to control individual brightness of at least some LED emitters of the plurality of LED emitters to cause the luminaire to emit the beam of light having the beam color associated with the percentage range that includes the numeric value.

4. The luminaire of claim 1, wherein the control system is configured, in further response to the Measure command, to cause the LED light source to emit a reduced intensity light beam having a reduced intensity when a previously received total reduction amount is greater than the current reduction amount.

5. The luminaire of claim 1, wherein:

the LED light source comprises the non-volatile memory, wherein the current intensity data representing the intensity signal is stored in the non-volatile memory of the LED light source; and the control system is configured to:

obtain the previous intensity data from the non-volatile memory of the LED light source.

6. The luminaire of claim 1, wherein:

the numeric value is a first numeric value;

the percentage range is a first percentage range; and the control system is configured to, after causing the LED light source to emit the reduced intensity light beam:

obtain a second intensity signal from the light sensor;

obtain reduced current intensity data representing the second intensity signal;

calculate a second numeric value representing a percentage by which the reduced current intensity data is less than the previous intensity data;

determine a second percentage range that includes the second numeric value, where the second percentage range is one of the plurality of percentage ranges; and cause the luminaire to emit a beam of light having the beam color associated with the second percentage range that includes the second numeric value.

7. The luminaire of claim 1, wherein the control system is configured to move the light sensor into and out of the light beam emitted by the LED light source.

8. The luminaire of claim 1, wherein the control system is configured, in further response to the Adjust command, to:

calculate an additional reduction amount by which the total reduction amount is greater than the current reduction amount; and cause the LED light source to emit the reduced intensity light beam by causing the LED light source to reduce an intensity of its emitted light beam by the additional reduction amount.

9. The luminaire of claim 8, wherein the control system is configured, in further response to the Adjust command, to:

store the additional reduction amount in the non-volatile memory; and cause the LED light source to reduce the intensity of its emitted light beam by the additional reduction amount when the luminaire is powered up from a powered-off state.

10. The luminaire of claim 9, wherein the Adjust command comprises Clear Flag data and the control system is configured to, in response to the Clear Flag data:

clear the additional reduction amount stored in the non-volatile memory; and cause the LED light source to emit the light beam at full intensity and to emit the light beam at full intensity when the luminaire is powered up from a powered-off state.

11. The luminaire of claim 9, wherein the LED light source comprises the non-volatile memory and the additional reduction amount is stored in the non-volatile memory of the LED light source.

12. A luminaire, comprising:

a light-emitting diode (LED) light source configured to emit a light beam;

a light sensor, optically coupled to the LED light source and configured to measure a current intensity of the light beam and produce an intensity signal based on the measured intensity; and a control system electrically coupled to the LED light source, to a non-volatile memory, and to the light sensor, the control system configured to:

obtain the intensity signal from the light sensor;

store in the non-volatile memory current intensity data representing the intensity signal;

obtain previous intensity data that represents a previously measured intensity of the light beam emitted by the LED light source;

calculate a numeric value representing a percentage by which the current intensity data is less than the previous intensity data;

determine a percentage range that includes the numeric value, where the percentage range is one of a plurality of percentage ranges, each percentage range of the plurality of percentage ranges having an associated beam color; and cause the luminaire to emit a beam of light having the beam color associated with the percentage range that includes the numeric value.

13. The luminaire of claim 12, wherein the control system is configured to move the light sensor into and out of the light beam emitted by the LED light source.

14. The luminaire of claim 12, wherein the control system is configured to cause the luminaire to emit the beam of light having the beam color associated with the percentage range that includes the numeric value in a preset direction.

15. The luminaire of claim 12, wherein the control system is configured to control a color changing system to cause the luminaire to emit the beam of light having the beam color associated with the percentage range that includes the numeric drop value.

16. The luminaire of claim 12, wherein:

the LED light source comprises a plurality of LED emitters; and the control system is configured to control individual brightness of at least some LED emitters of the plurality of LED emitters to cause the luminaire to emit the beam of light having the beam color associated with the percentage range that includes the numeric value.

17. The luminaire of claim 12, wherein:

the LED light source comprises the non-volatile memory, wherein the current intensity data representing the intensity signal is stored in the non-volatile memory of the LED light source; and the control system is configured to:

obtain the previous intensity data from the non-volatile memory of the LED light source.

* * * * *